United States Patent [19]

Fowler et al.

[11] Patent Number: 4,678,132

[45] Date of Patent: Jul. 7, 1987

[54] TRACTION DEVICE FOR LINE HANDLING EQUIPMENT

[75] Inventors: George A. Fowler, Dartmouth; James M. Hamilton, Halifax; William J. Whiteway, Windsor Junction, all of Canada

[73] Assignee: Canadian Patents and Development Limited, Ottawa, Canada

[21] Appl. No.: 930,244

[22] Filed: Nov. 13, 1986

[51] Int. Cl.[4] ..... B65H 51/26

[52] U.S. Cl. ..... 242/47.09; 242/54 R; 242/158 R

[58] Field of Search ..... 242/47.09, 47.08, 47.01, 242/47.1, 47.11, 47.12, 47.13, 54 R, 157.1, 158 R; 254/288, 283, 284, 285, 286

[56] References Cited

U.S. PATENT DOCUMENTS

| | | | |
|---|---|---|---|
| 1,849,983 | 3/1932 | Junkers | 242/47.09 |
| 2,074,022 | 3/1937 | Oppenlaender | 242/47.09 |
| 2,129,284 | 9/1938 | Uytenbogaart | 242/47.09 |
| 2,565,397 | 8/1951 | Schmitz, Jr. | 242/47.09 |
| 2,639,485 | 5/1953 | Ambler | 242/47.09 X |
| 2,682,335 | 6/1954 | Welsh et al. | 242/47.09 |
| 2,930,103 | 3/1960 | Stanley | 242/47.09 X |
| 3,747,863 | 7/1973 | Klementz et al. | 242/47.08 |

FOREIGN PATENT DOCUMENTS

| | | | |
|---|---|---|---|
| 885922 | 1/1962 | United Kingdom | 242/47.09 |

*Primary Examiner*—Stanley N. Gilreath
*Attorney, Agent, or Firm*—Ronald G. Bitner

[57] ABSTRACT

A traction device using grooveless traction rollers. An angled roller mounting arrangement allows a number of line wraps to traverse back and forth across the rollers, following the spooling on the storage reel without the aid of a fairlead system for deployment. The device provides for automatic separation of successive line wraps on the rollers to eliminate snagging of connectors or accessories attached to the line.

3 Claims, 2 Drawing Figures

TRACTION DEVICE FOR LINE HANDLING EQUIPMENT

FIELD OF THE INVENTION

This invention relates to a traction device for line handling equipment.

BACKGROUND OF THE INVENTION

The deployment and recovery of long mooring lines present dificulties that have not yet been satisfactorily overcome. Long lines involve the joining of a number of lines and the connectors, being of larger diameter than the line, are subject to snagging and complicate recovery of the line for which even spooling onto the storage reel is desired.

A known traction device uses a pair of grooved rollers to provide separation of the line wraps. However, with this device the wrap spacing is fixed, and a given device is suitable only for a limited range of line and/or connector size. Furthermore, since the lateral position of the line wraps on the grooved roller is constant, while the lateral position on the storage varies, there is a problem of bending of the line unless the traction device and storage reel are spaced a considerable distance apart, and hence such a system takes up considerable space. Also, such systems require a fairlead device for deployment as well as spooling-on.

SUMMARY OF THE INVENTION

It has been found that the deficiencies of the present devices can be overcome by groovless rollers arranged in a particular manner that will be described herein. The present invention provides that the line wraps on the traction device follow the spooling of the storage reel for deployment, or the fairlead for spooling-on. This allows the traction device to be positioned near the storage reel, allows a wide range of line sizes to be used, and does not require a fairlead device for deployment.

The present invention provides a traction device comprising; a first driven roller mounted with axis of rotation parallel to the axis of rotation of a storage reel, a second roller with axis of rotation oriented at an angle to that of the first roller and within a second plane parallel to a first plane defined by the axis of rotation of the first roller, said first and second rollers being operative to receive a plurality of wraps of a line and wherein the angle of the second roller is selected to provide the desired wrap spacing on the roller, and slidable support means for the second roller allowing displacement of the second roller axis within the second plane and in a direction generally normal to axis of rotation of the roller, and operative to be displaced by the action of the line wraps seeking to maintain constant total wrap length while traversing back and forth across the roller.

DESCRIPTION OF THE PREFERRED EMBODIMENT

Figure 1:
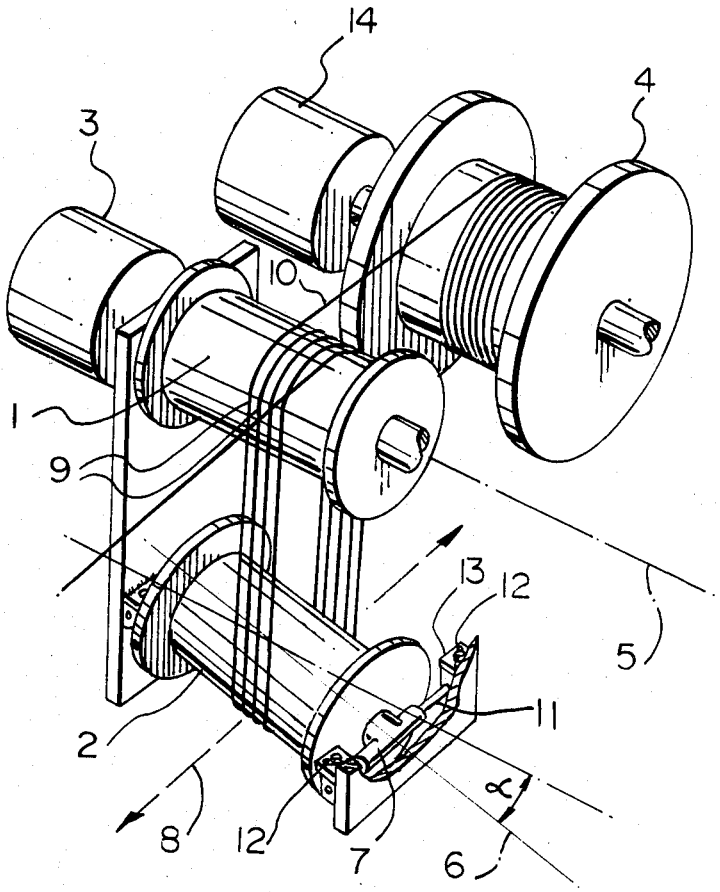
FIG. 1 is a schematic perspective illustration of one embodiment of the invention.
Figure 2:
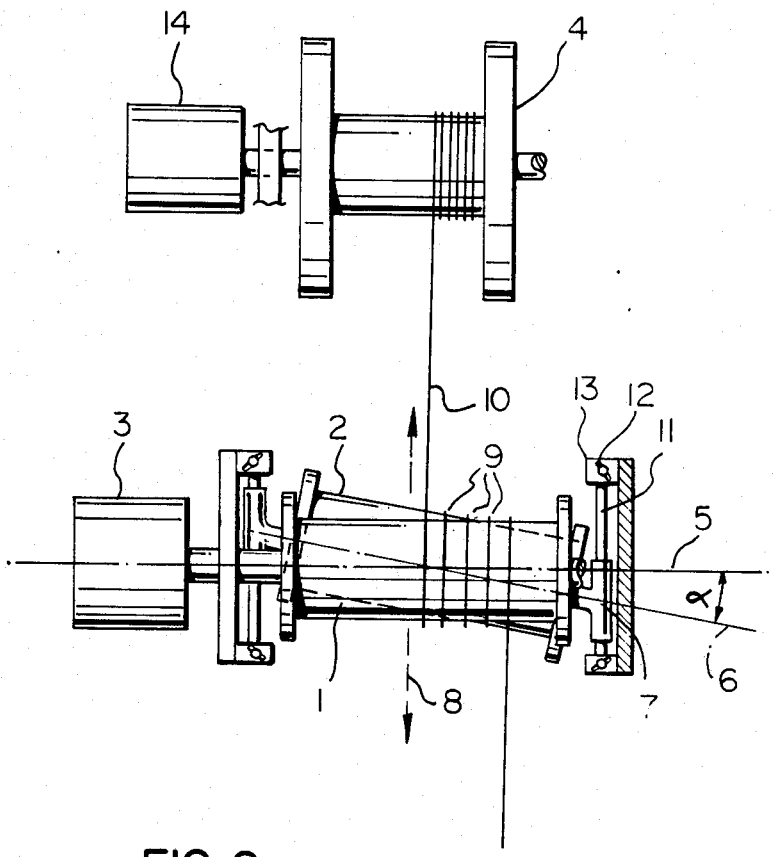
FIG. 2 is a plan view of the apparatus shown in FIG. 1.

Referring to FIGS. 1 and 2, the traction device of the present invention comprises a pair of rollers 1 and 2. Roller 1 is driven by suitable drive means 3 and is mounted with axis of rotation parallel to the axis of rotation of the storage reel 4. Roller 4 is slidably mounted with axis of rotation 6 at an angle to the axis 5 of roller 1, as can be best seen in FIG. 2. The axis 6 lies in a plane that is parallel to the plane defined by the axis 5 of the roller 1. Roller 2 is supported by slidable support means 7, which allows displacement of axis 6 within the aforesaid plane in a direction 8 that is generally normal to axis of rotation of the rollers, either 1 or 2.

The angle $\alpha$ is selected to provide the desired spacing of the line wraps 9 around rollers 1 and 2.

Preferably, the angle $\alpha$ will be made adjustable so that the wrap spacing can be readily altered for different line and/or connector size.

The support means 7 for roller 2 is shown slidably connected to shaft 11. Adjustment of the angle $\alpha$ of the roller 2 is provided by adjusting the position of the ends of the shaft 11. Adjustment is shown provided by means of elongated apertures in the supporting member 13. The elongated apertures 12 extend along an arc having its center at the central vertical axis of the roller 2. It will be noted that with the arrangement shown, adjustment of the angle also alters the direction (8) of sliding of roller 2. The exact direction of displacement (8) is not critical provided it is in the plane referred to above and generally in the direction normal to the rotating axis of the rollers, either 1 or 2.

For most common applications, the traction device will be used in conjunction with a storage reel 4, provided with suitable drive means 14, to provide a light tension to the line 10 while spooling-on or spooling-off in a conventional manner.

In operation, roller 1 is driven by suitable drive means 3, while a light tension is applied to the storage reel by suitable means 14. Roller 2, mounted at an angle to roller 1, slides freely in the fore and aft direction 8 generally normal to axis of rotation of the roller 1 or 2 guided by the slidable support means 7 on shaft 11.

The geometry of the two rollers causes the line to follow a helical path wherein the pitch, or wrap spacing, is equal to the tangent of the angle multiplied by the roller diameter, in the case of equal sized rollers. The angle will be selected to be adequate for the passage of connectors or accessories attached to the line without snagging adjacent wraps. The position of roller 2 relative to the roller 1 is self-adjusting in the fore and aft plane to keep the total wrapped length constant as the pack of wraps traverses back and forth across the rollers, following the spooling of the storage reel, when deploying line.

For recovery of line onto a storage reel, the pack of wraps will similarly follow a fairlead spooling system (not shown) positioned in front of the rollers in a conventional manner.

It should be noted that in the prior system, using grooved rollers, the fairlead device must be positioned between the traction device and storage reel to effect even spooling onto the storage reel. With the present invention, a fairlead spooling system is not required between the storage reel and rollers for deployment, and hence a more compact system is made possible.

Although the drawings show only one of the rollers being driven, it will be understood that the angled roller 2 may also be driven by suitable drive means.

The rollers 1 and 2 need not necessarily be of equal size. However, it can be seen that changing the size of either roller affects the wrap spacing for a given angle.

Also, the traction device is not necessarily limited to two rollers. Each of the rollers 1 and 2 may be replaced by two or more rollers to increase the effective diameter of the rollers in order to reduce bending stresses.

The number of wraps around the rollers will be chosen to accomodate the tension of the line without slipping on the rollers.

Preferably the rollers will be provided with a surface material with good wear characteristics and a high coefficient of friction, such as Polyurethane, which is presently in use for traction devices.

We claim:

1. A traction device for line handling equipment comprising:

a first driven roller mounted with an axis of rotation parallel to the axis of rotation of a storage reel;

a second roller with an axis of rotation oriented at an angle to that of the first roller and within a second plane parallel to a first plane defined by the axis of rotation of the first roller;

said first and second rollers being operative to receive a plurality of wraps of a line and wherein said angle is selected to provide the desired wrap spacing on the rollers; and slidable support means for the second roller allowing free displacement of the second roller axis within the second plane and in a direction generally normal to axis of rotation of the rollers, and operative to be displaced by the action of the line wraps seeking to maintain constant total wrap length while traversing back and forth across the rollers.

2. The traction device of claim 1 further comprising means for adjusting the angle of the axis or rotation of the second roller relative to the axis of rotation of the first roller, for varying the wrap spacing.

3. The traction device of claim 1, wherein the second roller is freely rotatable.

* * * * *